US006390462B1

(12) United States Patent
Ouchi et al.

(10) Patent No.: US 6,390,462 B1
(45) Date of Patent: May 21, 2002

(54) PAPER SUPPLY DEVICE AND IMAGE FORMING APPARATUS

(75) Inventors: Toshiaki Ouchi; Kazuto Yamamoto, both of Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/628,800

(22) Filed: Jul. 28, 2000

(51) Int. Cl.[7] ..... B65H 3/06

(52) U.S. Cl. ..... 271/109; 271/122; 271/167; 271/120

(58) Field of Search ..... 15/3, 21.1–88.4; 271/144, 120, 122, 126, 162, 167, 109

(56) References Cited

U.S. PATENT DOCUMENTS 5,145,163 A * 9/1992 Cowan et al. ..... 271/161 X

FOREIGN PATENT DOCUMENTS

JP 4-144846 * 4/1992 ..... B65H/3/46
JP 11-334911 12/1999

* cited by examiner

*Primary Examiner*—David H. Bollinger
*Assistant Examiner*—Kenneth W Bower
(74) *Attorney, Agent, or Firm*—Foley & Lardner

(57) ABSTRACT

The paper supply device according to the present invention includes a paper support member for supporting paper, a pick-up roller which is in contact with the paper and takes the paper out of the paper support member in a specified direction, and a removing member which is kept in contact with the pick-up roller and removes adherents to the pick-up roller and such a paper supply device is used to feed paper in an image forming apparatus.

15 Claims, 5 Drawing Sheets

PAPER SUPPLY DEVICE AND IMAGE FORMING APPARATUS

BACKGROUND OF THE INVENTION

1. Field of the Invention

This invention relates to a paper supply device which takes out sheets of paper and feeds them in a specified direction, and an image forming apparatus using the paper supply device.

2. Description of the Related Art

In a paper supply device used together with an image forming apparatus or the like, adherents such as paper trash may stick to the surfaces of pick-up rollers for taking sheets of paper out of a paper tray, paper supply cassette or the like when the rollers take out sheets of paper. With such adherents deposited, the rollers are incapable of smoothly taking out sheets of paper, and paper feed failure may eventually result. In this case the rollers must be replaced with a new one during maintenance work. To cope with this, apparatuses which bring a removing member into contact with pick-up rollers and remove adherents have been conventionally developed like that laid open to public inspection under Japanese Patent Application Laid-Open 11-334911.

However, this conventional removing member is brought into contact with pick-up rollers to remove adherents from their surfaces only when the pick-up rollers move away from sheets of paper, and adherents are not removed at all when the pick-up rollers are taking out sheets of paper. For the reason, when sheets of paper with more adherents, such as paper trash, like recycled paper and low-price imported paper which have recently become widespread, are continuously fed, operation of removing adherents is not performed until the pick-up rollers are brought apart from paper even if a removing member is installed. As a result, the adherents to the pick-up rollers will cause paper feed failure, and a paper jam will occur due to take-out failure, paper feed delay, or the like or display quality will be degraded due to skewing of paper.

Therefore, paper supply devices are demanded to feed sheets of paper via pick-up rollers with reliability regardless of the quality of the paper, even in case of continuous paper feed, and image forming apparatuses are demanded to obtain images with high display quality without causing any paper jam.

SUMMARY OF THE INVENTION

An object of the present invention is to efficiently remove adherents sticking to pick-up rollers which take out sheets of paper to prevent degradation in the functionality of the pick-up rollers, and feed sheets of paper with reliability without a paper jam due to paper feed failure even if sheets of paper involving much paper trash and the like are continuously fed.

A further object of the present invention is to take out sheets of paper toward an image forming means by means of pick-up rollers without fail regardless of the quality of the paper, by extension form images with high display quality without causing any paper jam, and provide a paper support means for supporting sheets of paper, a pick-up means for taking the sheets of paper out of the paper support means in a specified direction, and a removing means which is kept in contact with the pick-up means and removes adherents sticking to the pick-,up means.

Further, according to the present invention, a paper supply device is provided which paper supply device comprises a paper support, member which supports sheets of paper, pick-up rollers which take the sheets of paper out of the paper support member in a specified direction, and a removing member which is kept in contact with the pick-up rollers and removes adherents from the pick-up rollers.

Further, according to the present invention, an image forming apparatus is provided which image forming apparatus comprises a paper support member which is installed in the main body of the apparatus and supports sheets of paper, pick-up rollers which take the sheets of paper out of the paper support member, a removing member which is kept in contact with the pick-up rollers and removes adherents sticking to the pick-up rollers, an image forming means which is installed in the main body of the apparatus and forms images on the sheet of paper taken out by the pick-up rollers.

DETAILED DESCRIPTION OF THE PREFERRED EMBODIMENTS

Referring to the attached drawings, preferred embodiments of the present invention are described below in details.

Figure 1:
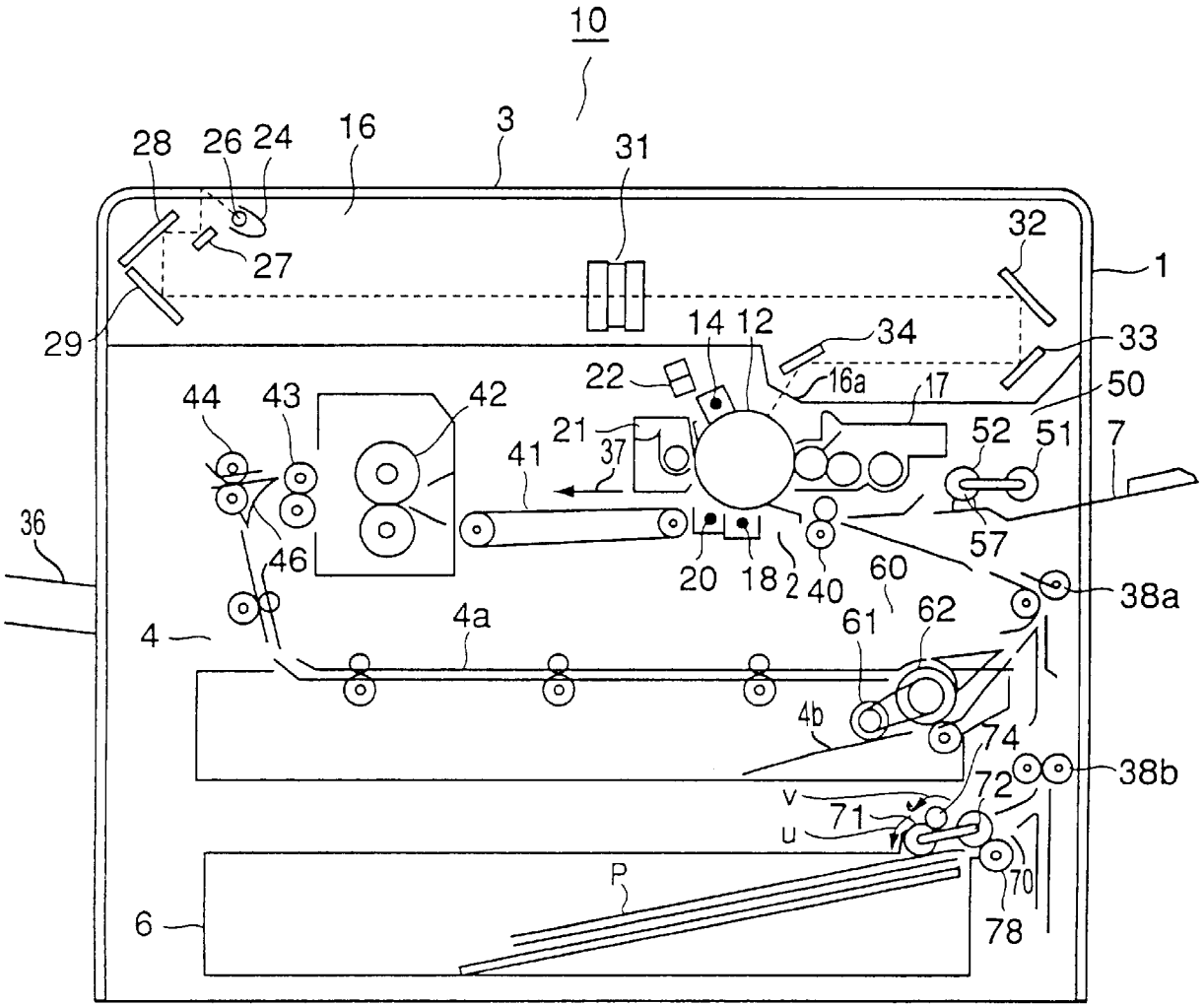
FIG. 1 is a schematic block diagram of an image forming apparatus embodying the present invention.
Figure 2:
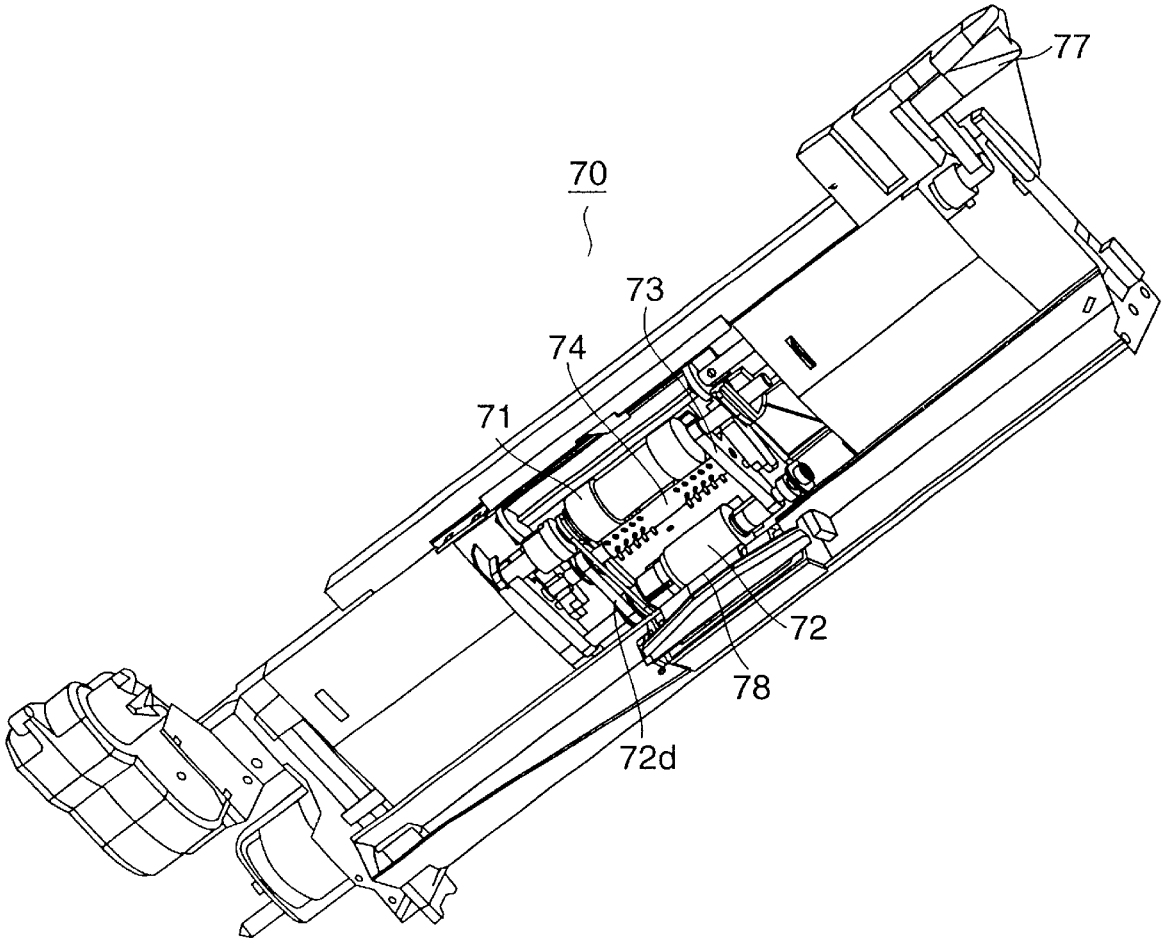
FIG. 2 is a perspective view illustrating a third paper supply device embodying the present invention, as seen from beneath.

FIG. 1 is a schematic block diagram illustrating the whole of an image forming apparatus 10 embodying the present invention, and there are first through third paper supply devices 50, 60, and 70 for taking out sheets of paper toward an image forcing means 2, provided in the main body I of the apparatus.) Document glass 3 on which an original is placed is installed on the top of the apparatus main body 1.

An automatic two-side device 4 provided width an inverting conveying path 4*a* for inverting paper P conveyed from the image forming means 2 during two-side copying and an inverting tray 4*b* as a paper support member is installed at the lower part of the apparatus main body 1. A front loading-type paper supply cassette device 6 which is a paper support member and supports paper P fed toward the image forming means 2 is installed under the automatic two-side device 4. A paper tray 7 which is a paper support member and supports paper P manually fed toward the image forming means 2 is installed on the right side of the apparatus main body 1.

A photosensitive drum 12 is placed in the apparatus main body 1, and a main charger 14, the exposing unit 16*a* of an exposure device 16, a developing device 17, a transferring charger 18, a releasing charger 20, a cleaner 21, and a charge remover lamp 22 comprising the image forming means 2 are placed in this order around the photosensitive drum 12 along the direction of its rotation. The exposure device 16 is so constituted that an original placed on the document glass 3 on the top of the apparatus main body 1 is irradiated with light from an exposure lamp 26 having a reflector 24, reflected light from the original is guided to a lens 31 by means of first through third mirrors 27–29, and the reflected light panned through the lens 31 is guided to the photosensitive drum 12 by means of fourth–sixth mirrors 32–34.

Further, a paper conveying path 37 through which paper P fed by the first through third paper supply devices 50–70 is guided from the automatic two-side device 4, the paper supply cassette device 6, and the paper tray 7 to a receiving tray 36 placed on the left side of the apparatus main body 1 through the photosensitive drum 12 is formed in the apparatus main body 1.

First and second conveying rollers 38*a* and 38*b* and an aligning roller 40 which aligns the ends of sheets of paper and conveys the sheets of paper in synchronization with the toner image on the photosensitive drum 12 are placed upstream from the photosensitive drum 12 in the paper conveying path 37. A conveyor belt 41, a fixing roller 42, a transmitting roller 43, and a gate 46 at which sheets of paper P are divided into those going to the receiving roller 44 and those going to the automatic two-side device 4 are installed downstream from the photosensitive drum 12 in the paper conveying path 27.

Then the first through third paper supply devices 50–70 are described in details. The paper supply devices 50–70 are respectively provided with the first through third pick-up rollers 91, 61, and 71 which take paper P out of the paper tray 7, the automatic two-side device 4, and the paper supply cassette device 6, and first through third paper supply rollers 52, 62, and 72.

Figure 4:
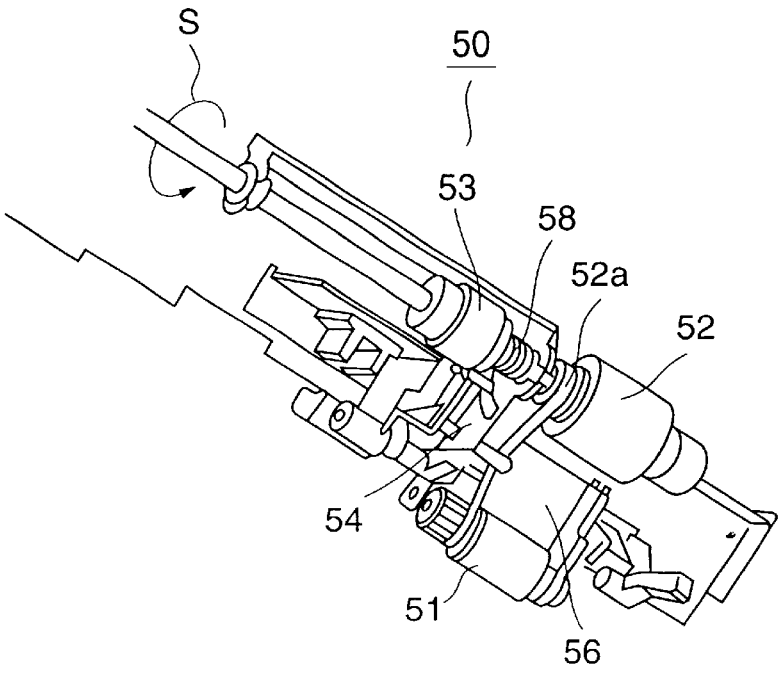
FIG. 4 is a schematic illustration of a mechanism for the vertical movement of the first pick-up roller of a first paper supply device embodying the present invention.

The first pick-up roller 51 is usually apart from the paper tray 7, and when driving force in the direction of the arrow s is applied to the first paper supply roller 52 from a motor (not shown), as shown in FIG. 4, rotational force is transmitted to a pick-up lever 54 through a spring clutch 53, and a pick-up arm 56 moves down under its own weight, the pick-up lever 54 being stopped in a position where the spring clutch 53 hits against its stopper (not shown). By the first pick-up roller 51 driven by driving force being transmitted from the first paper supply roller 52 through a belt 52*a*, sheets of paper P on the paper tray 7 are taken out, and the uppermost sheet of paper P is supplied toward the aligning roller 40 by the first paper supply roller 52 and a separating pad 57.

When paper feed from the paper tray 7 is completed and subsequently the driving force from the first paper supply roller 52 is ceased, the tip of the pick-up lever 54 is moved up by force from a lever spring 58, and thereby the pick-up arm 56 is moved up, and the first pick-up roller 51 is brought apart from the paper tray 7, paper feed operation being thus completed.

The second pick-up roller 61 is in contact with the inverting tray 4*b* of the automatic two-side device 4 and is rotatable both in the forward direction and in the reverse direction. That is, when, in two-side copying, paper P divided at the gate 46 is passed through the inverting conveying path 4*a* and reaches the second paper supply roller 62, the second paper supply roller 62 takes in the paper P toward the inverting tray 4*b* and places it on the inverting tray 4*b*. Then the second pick-up roller 61 takes the paper P out of the inverting tray 4*b*, and the paper is fed toward the aligning roller 40 by the second paper supply roller 62.

Figure 3:
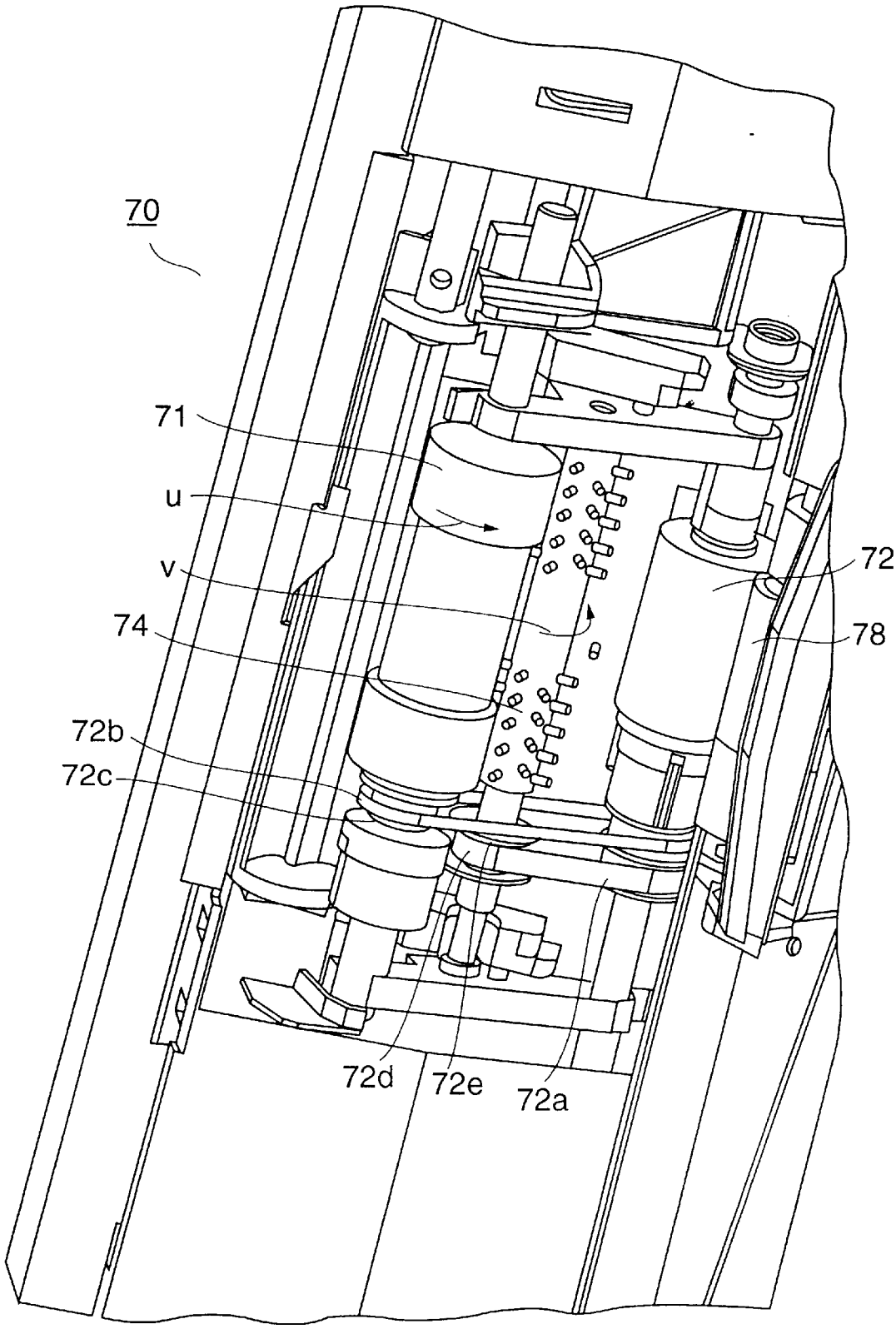
FIG. 3 is a partially enlarged view of FIG. 2 illustrating an embodiment of the present invention.

Then, in the third paper supply device 70, an arm 73 supports the third pick-up roller 71 and a removing brush 74, as shown in FIG. 3. The removing brush 74 is formed by implanting a brush made of nylon or the like in the surface of a roller, and so arranged that the removing brush is kept in slidable contact with the third pick-up roller 71 to remove adherents from its surface.

The third pick-up roller 71 is rotated in the direction of the arrow u by driving of the third paper supply roller 72 through a first pulley 72*a*, a first belt 72*b*, and a second pulley 72*c*, and paper P is taken out of the paper supply cassette device 6, the uppermost sheet of paper P being fed toward the aligning roller 40 by the third paper supply roller 72 and a separating roller 78. At the same time the driving force from the third paper supply roller 72 is transmitted to the removing brush 74 through the first pulley 72*a*, a second belt 72*d*, and a third pulley 72*e*, and the removing brush 74 is thereby rotated in the direction of the arrow v.

Therefore, the third pick-up roller 71 and the removing brush 74 are in slidable contact with each other and rotated in opposite directions to each other at the point of contact, the removing brush 74 removing adherents, such as paper trash, sticking to the surface of the third pick-up roller 71.

The third pick-up roller 71 and the removing brush 74 supported by the arm 73 are simultaneously moved up and down in the apparatus main body 1 when the paper supply cassette device 6 is loaded into or unloaded from the apparatus main body 1. That is, when the paper supply cassette device 6 is out of the apparatus main body 1, the third pick-up roller 71 is energized upward by a spring 76 through a link mechanism (not shown).

Figure 5:
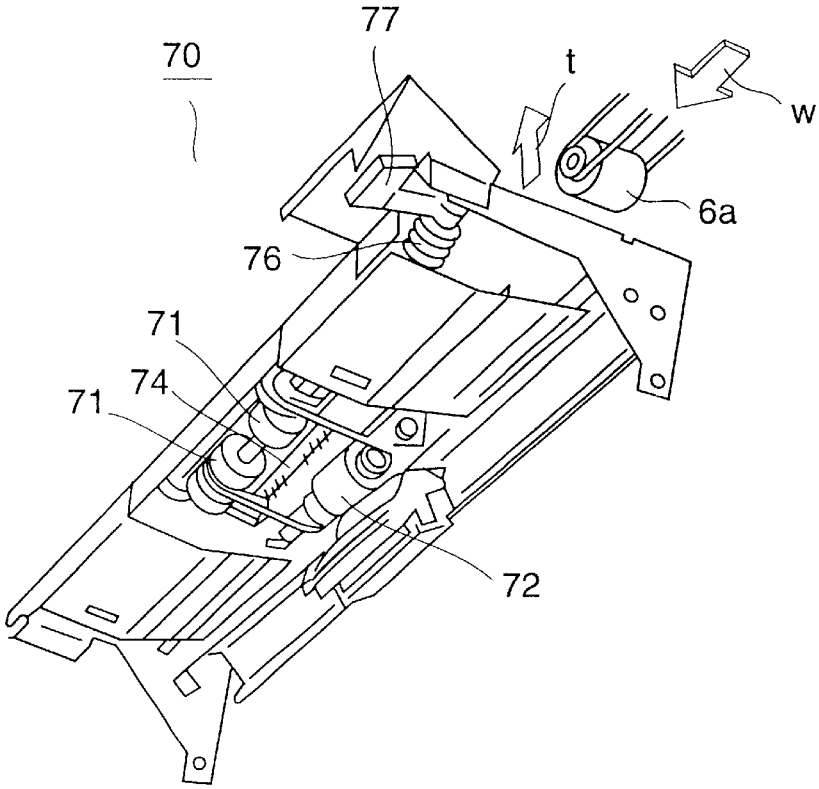
FIG. 5 is a schematic illustration of a mechanism for the vertical movement of the third pick-up roller and removing brush of a third paper supply device embodying the present invention.

When the paper supply cassette device 6 is loaded into the apparatus main body 1 from the front side, the third pick-up roller 71 is thereby moved down onto the paper P in the paper supply cassette device 6. That is, when the paper supply cassette device 6 is loaded into the apparatus main body 1 in the direction of the arrow w, as shown in FIG. 5 and as a result the cassette lever 6*a* of the paper supply cassette device 6 pushes up the up/down lever 77 of the third paper supply device 70 in the direction of the arrow t against the spring 76, the third pick-up roller 71 is relieved from the link mechanism (not shown) which supports the third pick-up roller, and moves down under its own weight to a position where it is brought into contact with the paper P in the paper supply cassette device 6. The removing brush 74 is moved down in synchronization with the third pick-up roller 71 through the arm 73.

When the paper supply cassette device 6 is thereafter unloaded from the apparatus main body 1, the cassette lever 6*a* is disengaged from the up/down lever 77 of the third pick-up roller 71, and the third pick-up roller 71 and the removing brush 74 in synchronization with the third pick-up roller 71 are moved up by the energizing force from the spring 76 through the link mechanism.

Then the principle of operation is described. When imaging conditions and the like required for image formation are entered and image forming operation is started, the photosensitive drum 12 rotates and thereby implements charging, exposing and developing steps in this order, and an toner image is formed.

As for the paper tray 7, the automatic two-side device 4, and the paper supply cassette device 6 on the paper feed side, specified paper P is fed from any of them by the first through third paper supply devices 50–70.

That is, in the first paper supply device 50, the first pick-up roller 51 is moved down to take paper P out of the paper tray 7, and in the second and third paper supply devices 60 and 70, paper P is respectively taken out of the automatic two-side device 4 and the paper supply cassette device 6 by the second and third pick-up rollers 61 and 71 in contact with the paper P, and fed toward the aligning roller 40.

The first through third pick-up rollers 51, 61, and 71 are respectively rotated by a required quantity to complete the taking-out of the end of paper P, inform any of the aligning roller 40, the first and second conveying rollers 38*a* and 38*b* of the completion of the conveyance of the paper P, and are then stopped.

During this period, in the third paper supply device 70 the third pick-up roller 71 is rotated in the direction of the arrow u to take paper P out of the paper supply cassette device 6, and further the removing brush 74 is rotated in the direction of the arrow v in contact with the third pick-up roller 71 to remove adherents, such as paper trash, sticking to the third pick-up roller 71.

Thereafter, the paper P taken out by any of the first through third paper supply devices 50–70 has its end aligned by the aligning roller 40, and conveyed to the transferring charger 18 position in synchronization with the toner image on the photosensitive drum 12. Then the paper P has the toner image on the photosensitive drum 12 transferred thereto in the transferring charger 18 position, released from the photosensitive drum 12 by the releasing charger 20, then conveyed to the fixing roller 42 by the conveyor belt 41. There the paper P has the toner image fixed by heating under pressure. Subsequently, the paper P with the toner image fixed thereon is conveyed toward a receiving roller 44 or the automatic two-side device 4 through the transmitting roller 43 and the gate 46. After the completion of transfer, the photosensitive drum 12 is rotated to be subjected to the cleaner 21 and the charge remover lamp 22, and is gotten ready for next copying operation.

In case the paper supply cassette device 6 is refilled with paper P while the above image forming operation is underway, the paper supply cassette device 6 is pulled out to the front side of the apparatus main body 1. As the third pick-up roller 71 is moved up when the paper supply cassette device 6 is pulled out, or as the third pick-up roller 71 is moved down when the paper supply cassette device 6 is loaded, the removing brush 74 in synchronization with the third pick-up roller 71 through the arm 73 is moved up and down in contact with the third pick-up roller 71.

When sheets of paper are continuously taken out of a paper supply cassette device, conventionally, paper feed failure often occurs after several sheets of paper are fed. However, when sheets of paper were continuously taken out of the paper supply cassette device 6 using the thus constituted third paper supply device 70, the sheets of paper were favorably fed without skewing or a paper jam even after 100 k sheets of paper were continuously fed.

According to this constitution, in the third paper supply device 70, the removing brush 74 is kept in contact with the third pick-up roller 71, and when the third pick-up roller 71 is being driven, the removing brush 74 is also rotated at its point of contact in opposite direction, thus the third pick-up roller 71 having adherents to its surface removed with reliability. Even if sheets of paper with much paper trash are used, the third pick-up roller 71 does not develop paper feed failure and the sheets of paper are fed without fail regardless of whether the sheets of paper are continuously fed or not. Application of such a third paper supply device 70 to an image forming apparatus 10 obtains images with high display quality without skewing of paper or a paper jam.

It is to be understood that the present invention is not limited to the above-mentioned embodiments and changes and variations may be made without departing from the spirit or scope of the following claims. For example, while in the above-mentioned embodiments, the removing brush is installed only on the third paper supply device which feeds the most paper to remove adherents from the surface of the third pick-up roller, the removing brush may be installed on the first or second paper supply device to remove adherents from the surface of the first or second pick-up roller. Furthermore, the pick-up rollers may be kept apart from paper and may be brought into contact with paper only when the paper is taken out.

The direction and speed of rotation of the removing brush relative to the pick-up roller are optional, and the rotation of the removing brush may be varied to avoid its being contact with the pickup roller at one and the same point for the prevention of uneven removal of adherents from the surface of the pick-up roller, deformation of the removing brush, and the like.

Figure 6:
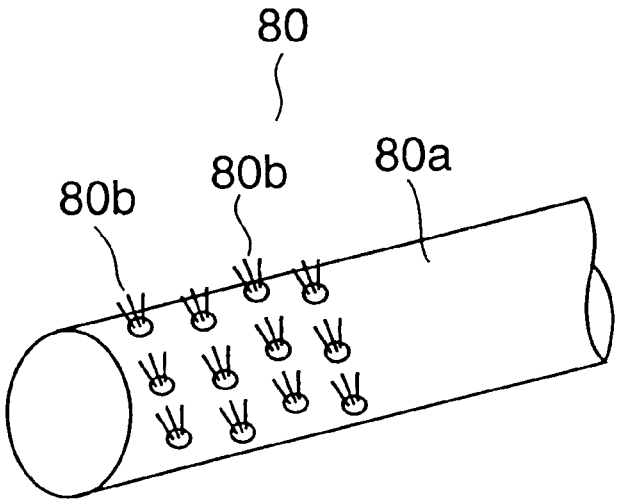
FIG. 6 is a partially schematic perspective view illustrating a first example of the modification to the removing brush embodying the present invention.
Figure 7:
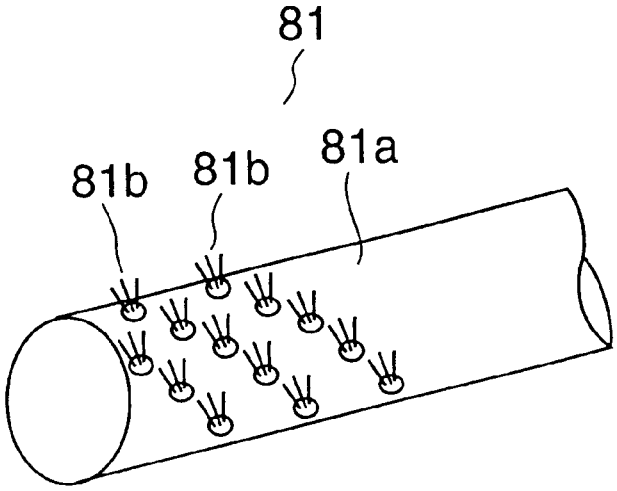
FIG. 7 is a partially schematic perspective view illustrating a second example of the modification to the removing brush embodying the present invention.

Further, the structure of the removing brush is also optional, and a removing brush 80 may be formed by implanting a brush 80*b* in the surface of a roller 80*a* in a zigzag pattern, like the first example of modification shown in FIG. 6, or a removing brush 81 may be formed by implanting a brush 81*b* in the surface of a roller 81*a* in a helical pattern, like the second example of modification shown in FIG. 7.

As described above in details, according to the present invention, paper trash can be removed from the surface of the pick-up roller without fail even in continuous feed operation by removing adherents, such as paper trash, sticking to the surface of the pick-up roller using the removing member kept in the pick-up roller while the pick-up roller is being driven. Therefore, paper feed failure due to adherents to the surface of the pick-up roller is prevented and paper is fed by the pick-up roller with reliability regardless of the quality of paper. Further, by applying such a paper supply device to an image forming apparatus, images with high display quality are obtained without skewing of paper or a paper jam and even after a long-time use. As a result, the frequency of replacement of the pick-up roller can be reduced, and the maintainability of the pick-up roller is enhanced

What is claimed is:

1. A paper supply device comprising:

paper support means for supporting paper;

pick-up means for taking the paper out of the paper support means in a specified direction; and removing means, which is kept in contact with the pick-up means and is rotated in synchronization with a rotating operation of the pick-up means, for removing adherents to the pick-up means, wherein the rotational speed of the removing means is variable.

2. A paper supply device as claimed in claim 1, wherein the rotational speed of the removing means is varied.

3. A paper supply device as claimed in claim 1, wherein the removing means has on its surface a brush in contact with the pick-up means.

4. A paper supply device as claimed in claim 3, wherein the brush is arranged in a zigzag pattern on the surface of the removing means.

5. A paper supply device as claimed in claim 3, wherein the brush is arranged in a helical pattern on the surface of the removing means.

6. A paper supply device comprising:

a paper support member for supporting paper;

a pick-up roller which takes the paper out of the paper support member in a specified direction; and a removing member, which is kept in contact with the pick-up roller and is rotated in synchronization with a rotating operation of the pick-up roller, and which removes adherents to the pick-up roller, wherein the rotational speed of the removing member is variable.

7. A paper supply device as claimed in claim 6, wherein the rotational speed of the removing member is varied.

8. A paper supply device as claimed in claim 6, wherein the rotational speed of the removing member is variable in relation to the rotational speed of the rotating operation of the pick-up roller.

9. A paper supply device as claimed in claim 6, wherein the rotational speed of the removing member is different than the rotational speed of the rotating operation of the pick-up roller.

10. A paper supply device as claimed in claim 6, wherein the removing member has on its surface a brush in contact with the pick-up roller.

11. A paper supply device as claimed in claim 10, wherein the brush is arranged in a zigzag pattern on the surface of the removing member.

12. A paper supply device as claimed in claim 10, wherein the brush is arranged in a helical pattern on the surface of the removing member.

13. An image forming apparatus comprising:

a paper support member which is placed in an apparatus main body and supports paper;

a pick-up roller which takes the paper out of the paper support member;

a removing member, which is kept in contact with the pick-up roller and is rotated in synchronization with a rotating operation of the pick-up roller, and which removes adherents to the pick-up roller, wherein the rotational speed of the removing member is variable; and image forming means, which is placed in the apparatus main body, for forming images on the paper taken out by the pick-up roller.

14. An image forming apparatus as claimed in claim 13, wherein the removing member has on its surface a brush in contact with the pick-up roller.

15. A paper supply device as claimed in claim 13, wherein the rotational speed of the removing member is varied.

* * * * *